US010991529B2

(12) United States Patent
Kotsuji et al.

(10) Patent No.: US 10,991,529 B2
(45) Date of Patent: Apr. 27, 2021

(54) GAS-BLAST CIRCUIT BREAKER

(71) Applicant: Hitachi, Ltd., Tokyo (JP)

(72) Inventors: Hideyuki Kotsuji, Tokyo (JP); Jun Nukaga, Tokyo (JP); Makoto Hirose, Tokyo (JP); Takahiro Nishimura, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 16/647,647

(22) PCT Filed: Aug. 3, 2018

(86) PCT No.: PCT/JP2018/029175
§ 371 (c)(1),
(2) Date: Mar. 16, 2020

(87) PCT Pub. No.: WO2019/073671
PCT Pub. Date: Apr. 18, 2019

(65) Prior Publication Data

US 2020/0279704 A1 Sep. 3, 2020

(30) Foreign Application Priority Data

Oct. 12, 2017 (JP) ..... JP2017-198150

(51) Int. Cl.
*H01H 33/42* (2006.01)
*H01H 33/70* (2006.01)

(52) U.S. Cl.
CPC .... *H01H 33/7069* (2013.01); *H01H 33/7023* (2013.01); *H01H 33/42* (2013.01)

(58) Field of Classification Search
CPC ..... H01H 33/7069; H01H 33/7023; H01H 33/56; H01H 33/7038; H01H 33/7053;
(Continued)

(56) References Cited

U.S. PATENT DOCUMENTS 6,271,494 B1 * 8/2001 Dienemann ..... H01H 33/245 218/48
7,619,177 B2 * 11/2009 Saxl ..... H01H 33/7061 218/57

(Continued)

FOREIGN PATENT DOCUMENTS

EP 2 362 407 A1 8/2011
JP 2-168524 A 6/1990

(Continued)

OTHER PUBLICATIONS

Translation JP2017-135000 (Original document published Aug. 3, 2017) (Year: 2017).*

(Continued)

*Primary Examiner* — William A Bolton
(74) *Attorney, Agent, or Firm* — Crowell & Moring LLP

(57) ABSTRACT

An object is to enhance direct-current insulating performance of a gas-blast circuit breaker. The gas-blast circuit breaker includes: a pair of main contacts disposed in a gas tank to face each other and configured to operate for opening and closing a circuit; a pair of arc contacts disposed to face each other and configured to operate for opening and closing the circuit, the arc contacts being disposed coaxially with the main contacts at locations close to the centers of the main contacts, respectively; and an elastic electrically conductive material disposed on an outer surface of an insulating nozzle facing an inner surface of one of the main contacts.

7 Claims, 7 Drawing Sheets

(58) Field of Classification Search
CPC .... H01H 33/90; H01H 33/903; H01H 33/904; H01H 33/91; H01H 33/24; H01H 33/396; H01H 33/42; H01H 2033/028
USPC .... 218/13, 14, 16.19, 51, 53, 57, 59–61, 63, 218/65, 72
See application file for complete search history.

(56) References Cited

U.S. PATENT DOCUMENTS

| | | | | |
|---|---|---|---|---|
| 7,642,480 | B2 * | 1/2010 | Ozil | H01H 33/904 218/14 |
| 8,129,647 | B2 * | 3/2012 | Haberer | H01H 33/7069 218/53 |
| 8,304,677 | B2 * | 11/2012 | Yoon | H01H 33/904 218/78 |
| 2015/0014280 | A1 * | 1/2015 | Cernat | H01H 33/72 218/157 |
| 2016/0203927 | A1 * | 7/2016 | Terada | H01H 33/42 218/154 |

FOREIGN PATENT DOCUMENTS

| | | | |
|---|---|---|---|
| JP | 2004-119290 | A | 4/2004 |
| JP | 2012-54097 | A | 3/2012 |
| JP | 2017-135000 | A | 8/2017 |

OTHER PUBLICATIONS

Translation JP 2-168524 (Original document published Jun. 28, 1990) (Year: 1990).*
International Search Report (PCT/ISA/210) issued in PCT Application No. PCT/JP2018/029175 dated Oct. 2, 2018 with English translation (three (3) pages).
Japanese-language Written Opinion (PCT/ISA/237) issued in PCT Application No. PCT/JP2018/029175 dated Oct. 2, 2018 (five (5) pages).

* cited by examiner

GAS-BLAST CIRCUIT BREAKER

TECHNICAL FIELD

The present invention relates to a circuit breaker, particularly to a gas-blast circuit breaker for blowing insulating gas to extinguish an arc in order to interrupt electric current.

BACKGROUND ART

Recently, electric power systems have been made to deal with higher voltage and larger current. In order to achieve the required circuit breaking performance, gas-blast circuit breakers with a larger capacity have been developed.

With reference to FIG. 9, the following will describe a schematic configuration of a conventional gas-blast circuit breaker and how the conventional gas-blast circuit breaker operates for interrupting electric current. The gas-blast circuit breaker is accommodated in a gas tank (not illustrated) filled with insulating gas. Normally, a driving-side arc contact 1 on an operation device side and a driven-side arc contact 2 on a side facing the operation device are electrically connected to each other, and a driving-side main contact 3 and a driven-side main contact 4 are electrically connected to each other. However, when an accident happens and a command to open the circuit is given, the driving side is actuated by the operation device (not illustrated) via a puffer shaft 6 and an insulating rod (not illustrated), which causes a transition to a state where the driving-side arc contact 1 on the driving side and the driven-side arc contact 2 on the driven side are physically separated from each other and the driving-side main contact 3 and the driven-side main contact 4 are physically separated from each other.

Even after the contacts are separated from each other, electric current still flows between the driving-side arc contact 1 and the driven-side arc contact 2, which causes generation of an arc. The gas-blast circuit breaker blows high-pressure insulating gas to the arc to extinguish the arc. While the driving side is operating, insulating gas in a puffer chamber 9 is compressed by a puffer piston 8, and is blown into an arc space 10, so that the arc is extinguished. At the time of the extinguishment of the arc, hot gas is generated, which flows through a driving-side exhaust gas guide and then is discharged into a tank. To increase the pressure of the insulating gas in the puffer chamber 9 is important to enhance the circuit breaking performance for extinguishing the arc.

Recently, for the purpose of reducing operation power, a heat puffer type gas-blast circuit breaker has been developed that utilizes arc heat to achieve a pressure of gas to be blown to arc. Meanwhile, for the purpose of enhancing the circuit breaking performance, a bidirectional driving type gas-blast circuit breaker has been proposed that drives a driven-side electrode, which has been fixed in the conventional configuration, in a direction opposite to a driving direction of a driving-side electrode.

With reference to FIG. 1, the following will explain how the bidirectional driving type gas-blast circuit breaker operates. A driving side and a driven side are coupled to each other by a driving-side coupling rod 21 via an insulating nozzle 5 and a lever 22. The lever 22 is turnably fixed to a guide 27 with a lever fixing pin 23. The lever 22 is coupled to a driven-side rod 26 with a driven-side pin 25. Pulling with an operation device toward the driving side causes the whole of the driving-side coupling rod 21, which is connected to the insulating nozzle 5, to move toward the driving side. In response to the movement of the driving-side coupling rod 21, the lever 22 turns around the lever fixing pin 23, whereby the driven-side rod 26 and a driven-side arc contact 2 move, via the driven-side pin 25, in a direction away from the driving side.

In addition, as a result of an increase in pressure of the gas to be blown, internal pressures applied to a puffer cylinder 7 and the insulating nozzle 5 have been increased. The insulating nozzle 5 is often made of an insulating material excellent in heat resistance and insulating property. However, the insulating nozzle 5 is weak in mechanical strength, and thus may potentially be deformed due to an increase in pressure that occurs during circuit breaking operation. According to PTL 1, the insulating nozzle 5 has an outer circumferential surface covered with an insulating material excellent in insulating property. In this manner, PTL 1 reinforces the insulating nozzle 5 without giving any effect on the electric field. The mechanical strength may alternatively be enhanced by increasing a radial thickness of the insulating nozzle 5 or by covering the outer circumferential surface of the insulating nozzle 5 with a metallic component having an excellent mechanical strength. The outer circumferential surface of the insulating nozzle 5 may be covered with a metallic component excellent in mechanical strength in the following manner. That is, the driving-side main contact 3 may be designed to have an inner diameter that allows an inner surface of the driving-side main contact 3 to be in contact with the outer surface of the insulating nozzle 5. This configuration can enhance the strength of the insulating nozzle 5 without adding any component, and thus is advantageous in terms of cost. Ideally, the insulating nozzle 5 may be designed to have an outer diameter identical to an inner diameter of the driving-side main contact 3. However, considering an allowance, ease of assembling, and the like, the insulating nozzle 5 should be designed to have an outer diameter with a negative allowance, and the driving-side main contact 3 should be designed to have an inner diameter with a positive allowance. This configuration may potentially create a minute gap. In addition, the insulating nozzle 5, which is made of a resin, and the driving-side main contact 3, which is made of a metal, have different coefficients of thermal expansion, and therefore the minute gap 14 may be increased or reduced.

In the circuit breaker of the bidirectional driving type, the driving side and the driven side are connected to each other via the driving-side coupling rod 21 even while the circuit is opened. Accordingly, the voltage across the electrodes is applied to the insulating nozzle 5. The gas-blast circuit breaker has various interruption duties. When the gas-blast circuit breaker interrupts leading small current, such as charging current in a no-load transmission line and/or a capacitor for power adjustment, direct-current voltage may be applied to one side of the circuit breaker. In order to deal with this, the bidirectional driving type gas-blast circuit breaker is configured such that the electrodes are connected to each other via an insulator. In the gas-blast circuit breaker in which the electrodes are connected to each other via the insulator, a dielectric constant is dominant in an alternating-current electric field, and an electric conductivity is dominant in a direct-current electric field.

CITATION LIST

Patent Literature

PTL 1: JP 2012-54097 A

SUMMARY OF INVENTION

Technical Problem

FIG. 5 shows typical equipotential lines observed when alternating-current voltage is applied to the bidirectional driving type gas-blast circuit breaker, whereas FIG. 6 shows typical equipotential lines observed when direct-current voltage is applied to the bidirectional driving type gas-blast circuit breaker. As illustrated in FIG. 5, while alternating-current voltage is applied, an electric potential distribution is determined depending on metallic components, such as the main contact, the arc contact, and a shield 12.

On the other hand, while direct-current voltage is applied, the electric potential distribution becomes equal at the insulating nozzle 5, which is an insulator, as illustrated in FIG. 6. FIG. 2 shows an enlarged view of a part around the minute gap 14 between the insulating nozzle 5 and the driving-side main contact 3. When the minute gap is created between the insulating nozzle 5, which is an insulator, and the driving-side main contact 3, which is made of a metal, the equipotential lines are concentrated in the minute gap 14 and a high electric field is generated in the minute gap 14, as illustrated in FIG. 2. Insulation breakdown may potentially start from this point.

An object of the present invention is to provide a bidirectional driving type gas-blast circuit breaker involving little impairment in insulating performance.

Solution to Problem

This object can be attained by a gas-blast circuit breaker including: a driving-side main contact and a driven-side main contact placed in a gas tank to face each other and configured to operate for opening and closing a circuit; a driving-side arc contact and a driven-side arc contact placed to face each other and configured to operate for opening and closing the circuit; a puffer shaft to which the driving-side arc contact is coupled; a puffer cylinder fixed at a location outside the puffer shaft coaxially with the puffer shaft, the puffer cylinder having an end provided with the driving-side main contact; an insulating nozzle fixed to the end, the insulating nozzle providing a space in which an arc is generated when the circuit is opened by the driving-side arc contact and the driven-side arc contact; a driver configured to drive the puffer shaft; and a puffer chamber in which arc-extinguishing gas being to be supplied to the space is stored, wherein the insulating nozzle is coupled to a driving rod, the driving rod is connected to a driven rod via a lever, the driven rod is electrically connected to the driven-side arc contact, and an elastic electrically conductive material is provided on an outer surface of the insulating nozzle, the outer surface of the insulating nozzle facing an inner surface of the driving-side main contact.

Advantageous Effects of Invention

According to the present invention, it is possible to reduce impairment in insulating performance of a bidirectional driving type gas-blast circuit breaker.

DESCRIPTION OF EMBODIMENTS

The following will describe embodiments of the present invention with reference to the drawings. The embodiments below are presented merely by way of examples, and there is no intention to limit the contents of the present invention to the modes specifically shown below. The invention itself can be implemented in various modes, as long as they accord to the contents recited in the claims.

Embodiment 1

Figure 1:
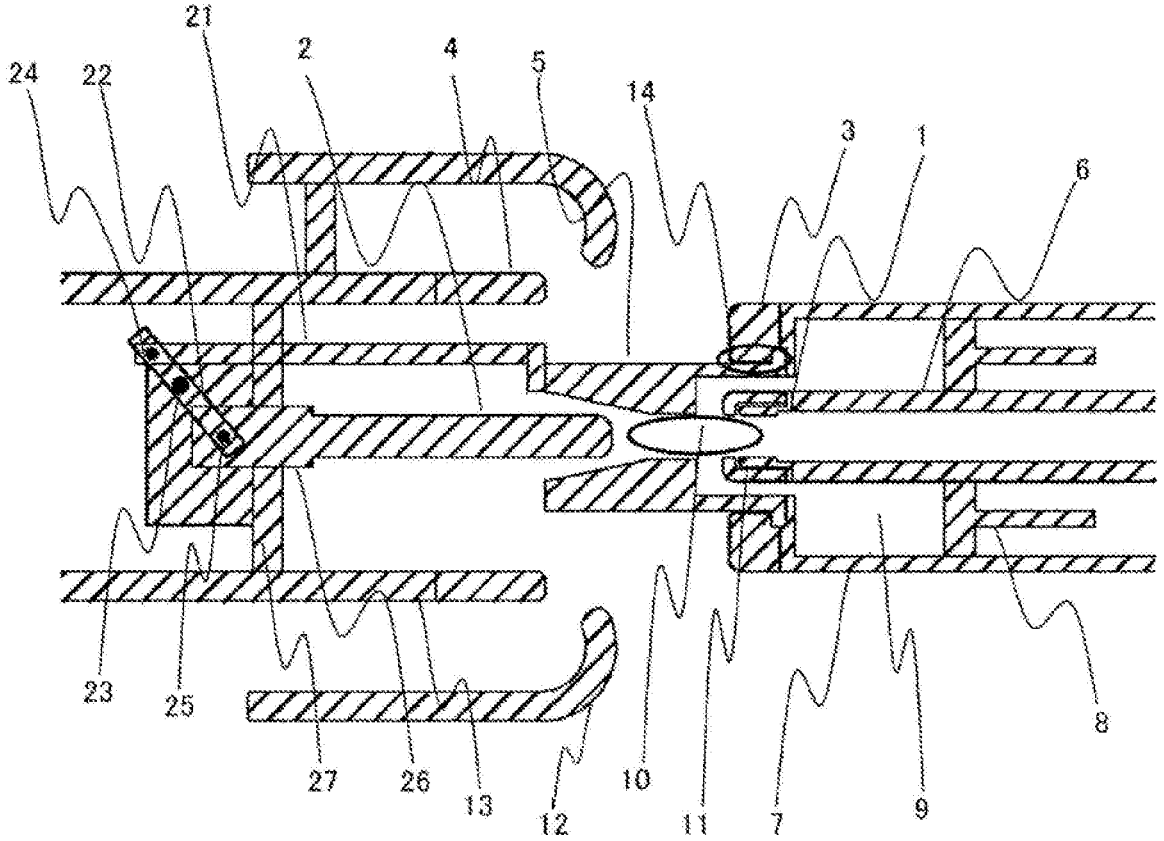
FIG. 1 is a cross-sectional view of a portion of a conventional bidirectional driving type gas-blast circuit breaker.
Figure 2:
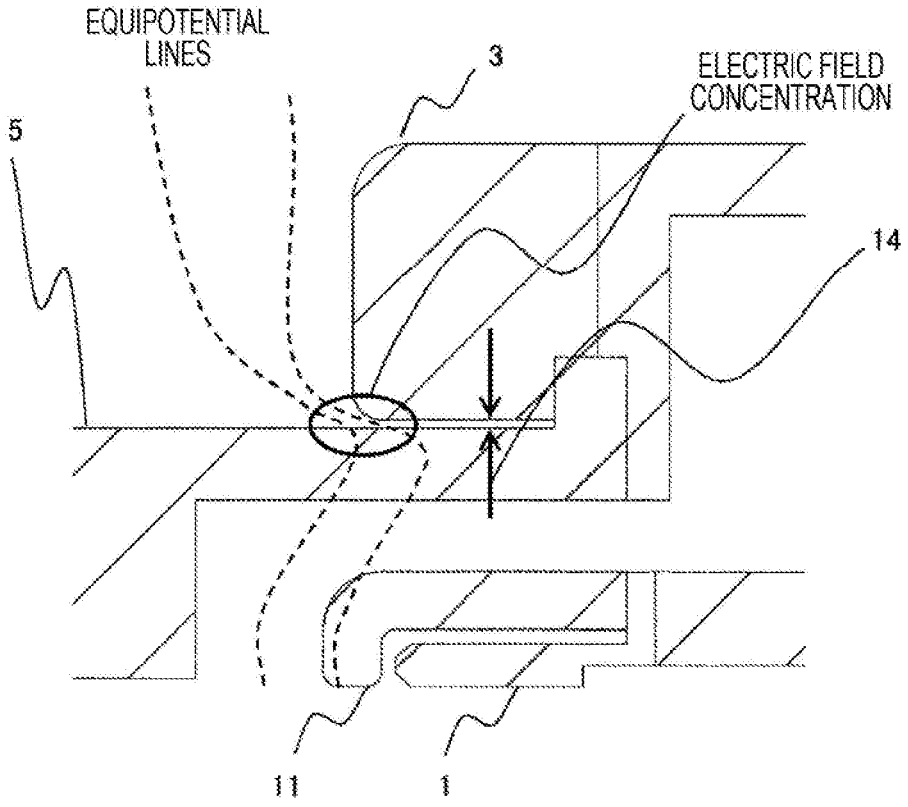
FIG. 2 is an enlarged cross-sectional view of a portion around of an insulating nozzle and a driving-side main contact of the conventional bidirectional driving type gas-blast circuit breaker.

Although not illustrated in FIG. 1, a circuit breaker includes a puffer shaft 6 connected to an operation device (not illustrated) via an insulating rod (not illustrated), and the circuit breaker is entirely accommodated in a gas tank filled with $SF_6$ gas.

As illustrated in FIG. 1, the circuit breaker according to the present embodiment has a schematic configuration including a driving-side arc contact 1, a puffer cylinder 7, a puffer chamber 9 that is a space surrounded by the puffer cylinder 7, a puffer piston 8, the puffer shaft 6, a movable element cover 11, and an insulating nozzle 5, a driving side constituted by a driving-side main contact 3, and a driven side constituted by a driven-side main contact 4, a driven-side arc contact 2, a driven rod 26, and a guide 27.

The driving side and the driven side are connected to each other with a driving-side coupling rod 21 via the insulating nozzle 5 and the lever 22. The driving-side coupling rod 21 is coupled to the lever 22 with a driving-side pin 24. The lever 22 is turnably fixed to the guide 27 with a lever fixing pin 23. The lever 22 is coupled to a driven-side rod 26 with a driven-side pin 25.

FIG. 1 shows the gas-blast circuit breaker observed after operation has been performed. In a power-on state, the driving side moves leftward on FIG. 1, so that the driving-side main contact 3 and the driven-side main contact 4 are electrically connected to each other and the driving-side arc contact 1 and the driven-side arc contact 2 are electrically connected to each other. When the circuit breaker goes into operation, the driving side is driven by an operation device via the puffer shaft 6 in a direction toward the operation device, so that the driving-side main contact 3 and the driven-side main contact 4 are separated from each other and the driving-side arc contact 1 and the driven-side arc contact are separated from each other. At this time, an arc is generated in the arc space 10 between the driving-side arc contact 1 and the driven-side arc contact 2. As a result of mechanical compression performed by the puffer piston 8 in the puffer chamber 9, insulating gas is blown into the arc space 10 so that the arc is extinguished, whereby electric current is interrupted.

Figure 3:
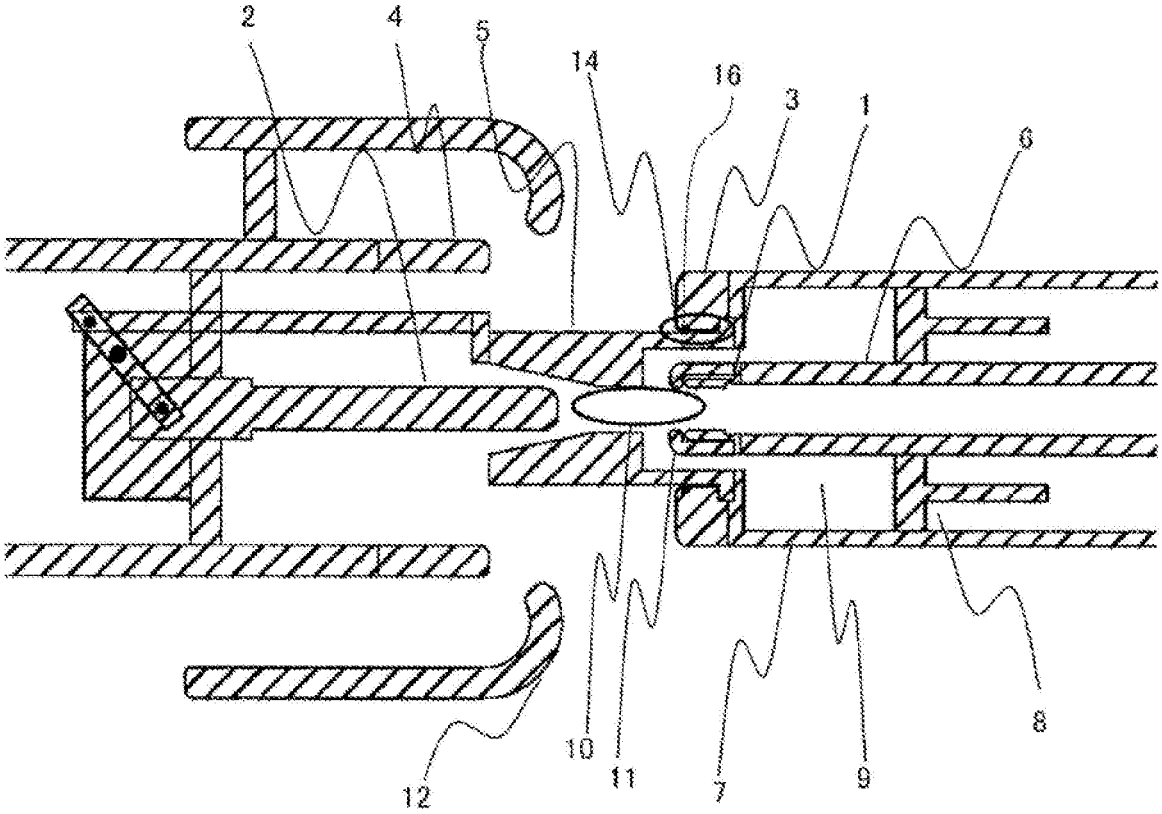
FIG. 3 is a cross-sectional view of a portion of a gas-blast circuit breaker according to a first embodiment.
Figure 4:
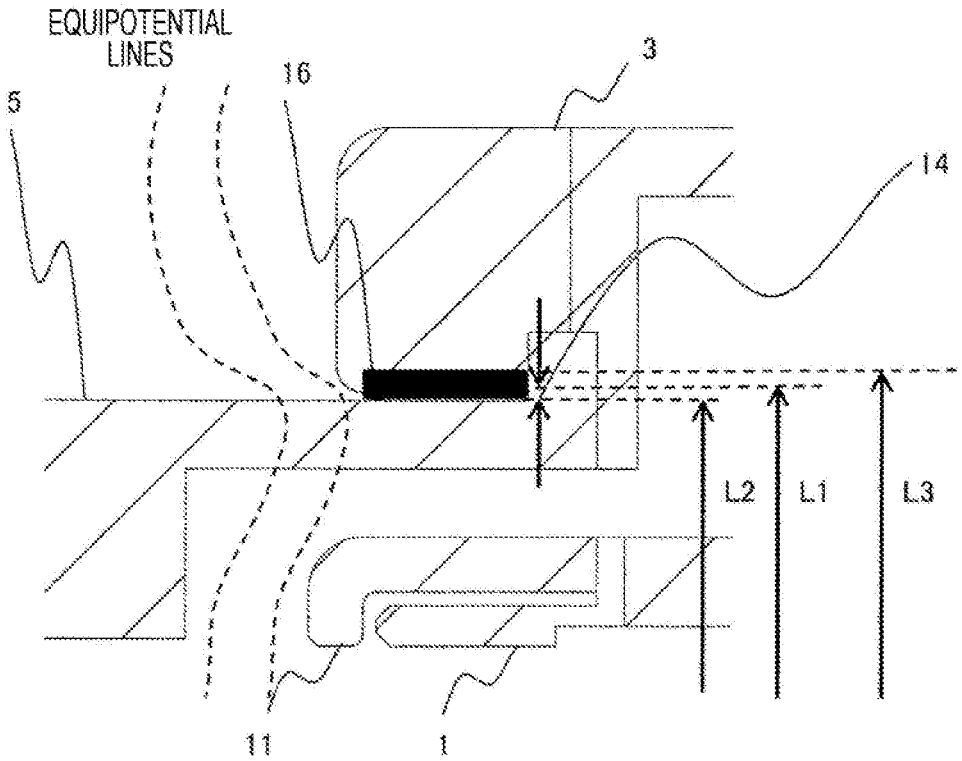
FIG. 4 is an enlarged cross-sectional view of a portion around an insulating nozzle and a driving-side main contact of the gas-blast circuit breaker according to the first embodiment.
Figure 5:
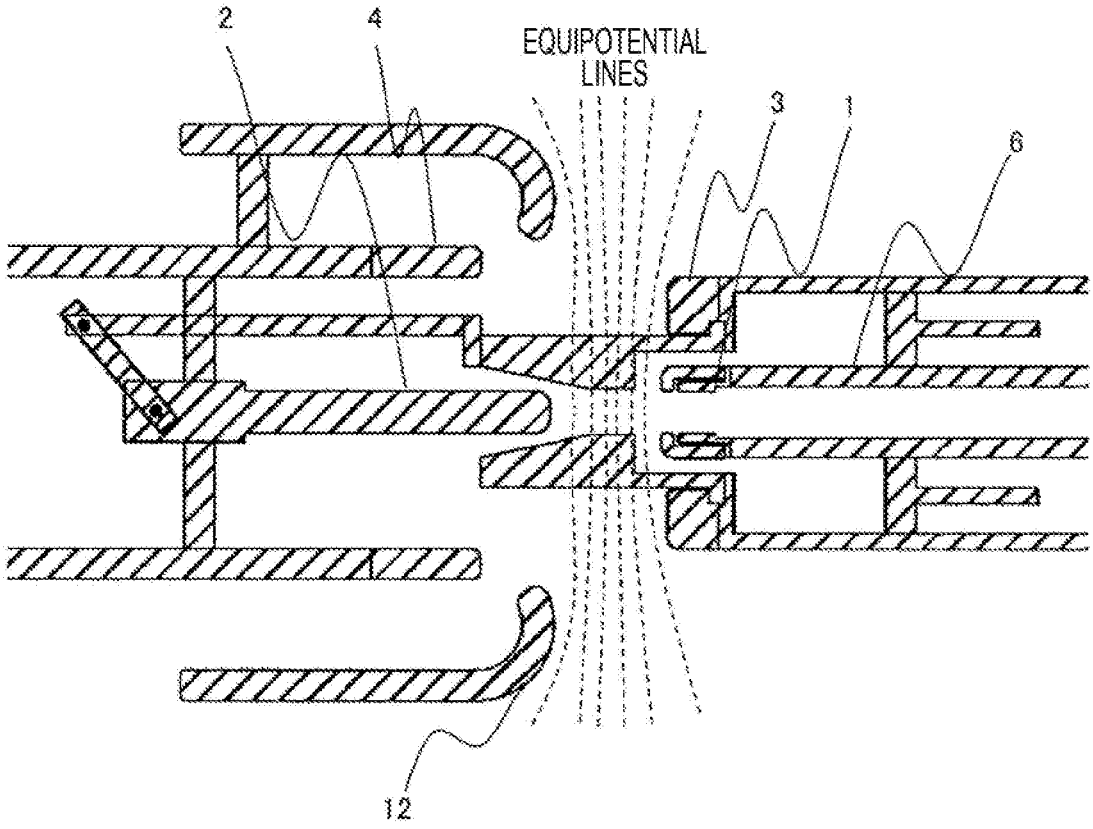
FIG. 5 is a cross-sectional view showing typical equipotential lines in a portion of the conventional bidirectional driving type gas-blast circuit breaker observed when alternating-current voltage is applied.
Figure 6:
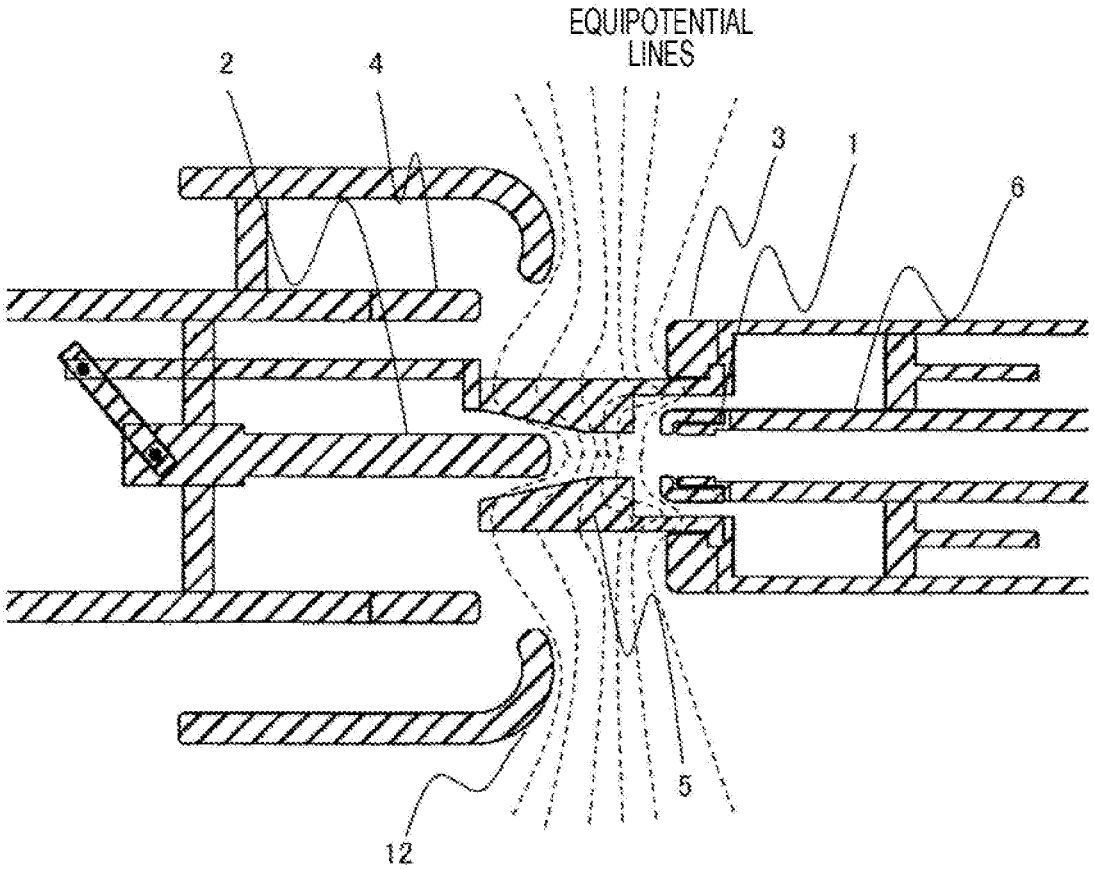
FIG. 6 is a cross-sectional view showing typical equipotential lines in a portion of the conventional bidirectional driving type gas-blast circuit breaker observed when direct-current voltage is applied.

With reference to FIGS. 3 and 4, the following will explain Embodiment 1. In the process of interruption of electric current, an ambient pressure of the arc space 10 increases due to not only the mechanical compression but also arc heat, and consequently internal pressures of the puffer cylinder 7 and the insulating nozzle 5 also increase. In order to suppress deformation of the insulating nozzle 5 that may be caused by the increased internal pressures, the driving-side main contact 3 is designed to have an inner diameter L1 with a positive allowance relative to an outer diameter L2 of the insulating nozzle 5. In addition, an electrically conductive member 16, which is made of an elastic member, such as an O-ring, is arranged in a minute gap 14 created between the driving-side main contact 3 and the insulating nozzle 5. The electrically conductive member 16 is designed to have an outer diameter L3 with a positive allowance and an inner diameter L2 with a negative allowance. The configuration such as those illustrated in FIG. 4 allows the electrically conductive member 16 to be crushed, thereby filling the minute gap 14 between the driving-side main contact 3 and the insulating nozzle 5. With the configuration in which the electrically conductive member 16 is designed to have the outer diameter L3 with a positive allowance and the inner diameter L2 with a negative allowance, even if the insulating nozzle 5 expands or contracts, the minute gap 14 would not be created, electrical connection would be attained, and a high electric field would not be generated due to concentration of equipotential lines in the minute gap 14.

Embodiment 2

Figure 7:
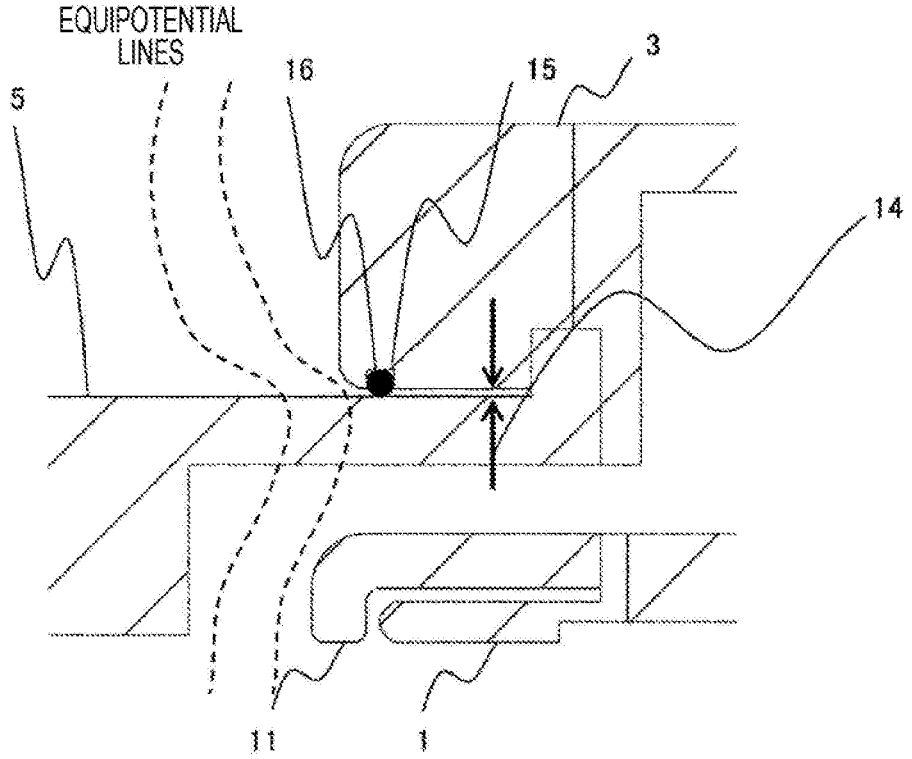
FIG. 7 is an enlarged cross-sectional view of a portion around an insulating nozzle and a driving-side main contact of a gas-blast circuit breaker according to a second embodiment.

With reference to FIG. 7, the following will explain Embodiment 2. In the present embodiment, a groove 15 is provided in an inner circumferential surface of a driving-side main contact 3. By fitting a spring contact, which is one example of an electrically conductive member 16, into the groove 15 in the inner circumferential surface, it is possible to electrically connect the insulating nozzle 5 to the driven-side contact 3. This can prevent intrusion of equipotential lines into a minute gap 14, thereby suppressing generation of a high electric field.

Embodiment 3

Figure 8:
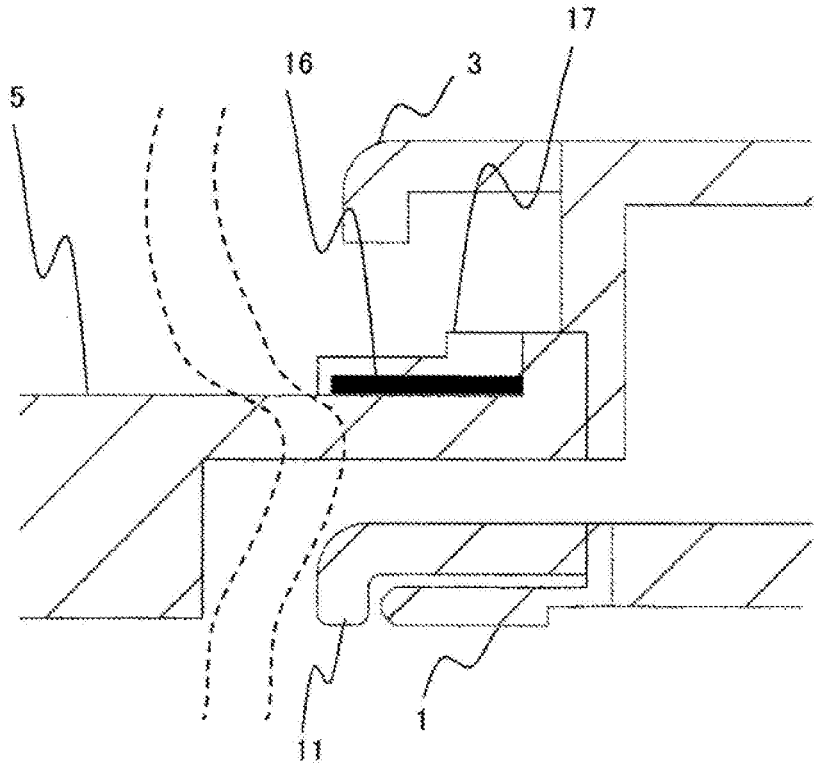
FIG. 8 is an enlarged cross-sectional view of a portion around an insulating nozzle and a driving-side main contact of a gas-blast circuit breaker according to a third embodiment.
Figure 9:
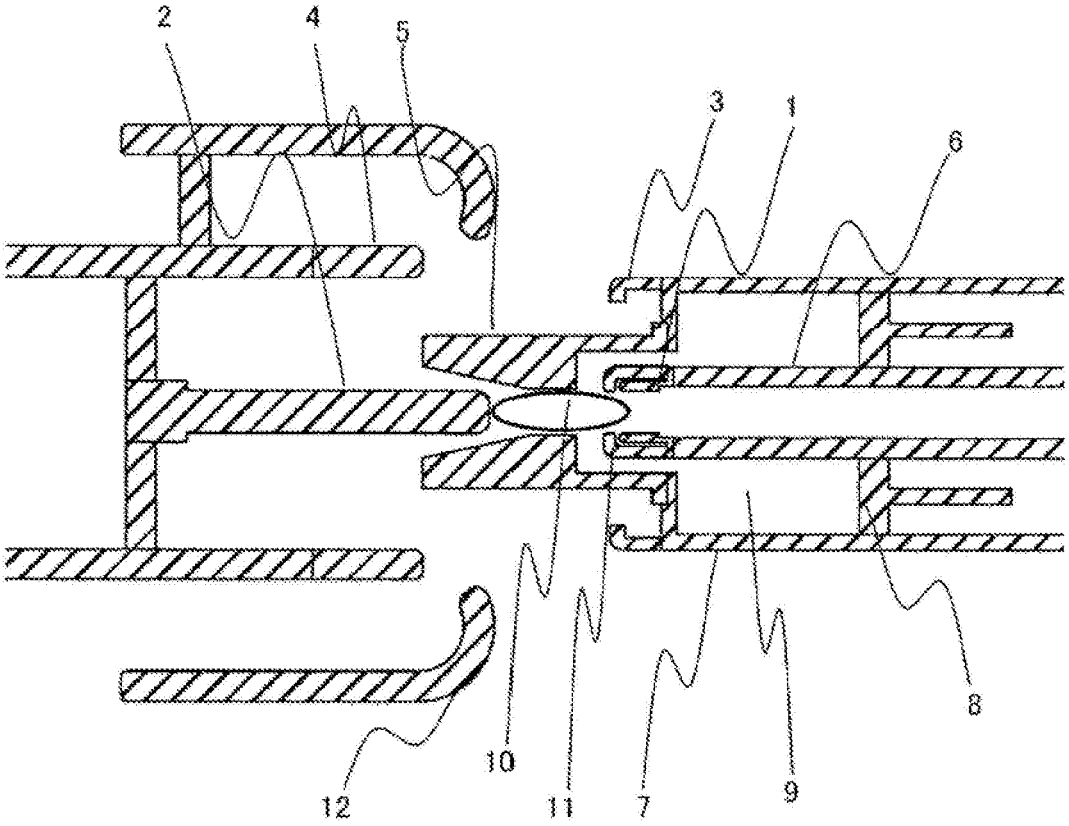
FIG. 9 is a cross-sectional view of a portion of a conventional gas-blast circuit breaker.

With reference to FIG. 8, the following will explain Embodiment 3. According to Embodiments 1 and 2, the driving-side main contact 3 is designed to have the inner diameter that allows an inner surface of the driving-side main contact 3 to be in contact with the outer surface of the insulating nozzle 5. This configuration can reduce the number of components, but increases the weight of a driving part. With a configuration including a reinforcing member 17 as illustrated in FIG. 8 designed to have an inner circumferential surface provided with an electrically conductive member 16, which is sandwiched by the reinforcing member 17 and the insulating nozzle 5, it is possible to reduce the weight of the driving side, as compared to the driving-side main contact 3. Consequently, it is possible to achieve the effects similar to those of Embodiments 1 and 2.

The examples in Embodiments 1, 2, and 3 described above each show the puffer type circuit breaker configured to attain a pressure for blowing gas by mechanical compression performed by the puffer piston 8. Alternatively, a heat puffer type circuit breaker that includes a heat puffer chamber having a fixed capacity and that is configured to take in arc heat to achieve a pressure for blowing gas is applicable to the present invention.

The insulating gas used in the embodiments described above is $SF_6$. However, the type of insulating gas is not limited to $SF_6$, and may be another type of insulating gas, such as dry air or nitrogen gas.

Herein, the example of the structure in which the electrodes are connected to each other via the insulator is the bidirectional driving type circuit breaker. Another structure in which electrodes are connected to each other via an element that is not the insulating nozzle 5, such as an insulating cylinder or an inter-electrode capacitor, is also applicable.

REFERENCE SIGNS LIST

1 driving-side arc contact
2 driven-side arc contact
3 driving-side main contact
4 driven-side main contact
5 insulating nozzle
6 puffer shaft
7 puffer cylinder
8 puffer piston
9 puffer chamber
10 arc space
11 movable element cover
12 shield
13 driving-side exhaust gas guide
14 minute gap
15 groove
16 electrically conductive member
17 reinforcing member
21 driving-side coupling rod
22 lever
23 lever fixing pin
24 driving-side pin
25 driven-side pin
26 driven rod
27 guide

The invention claimed is:

1. A gas-blast circuit breaker comprising:

a driving-side main contact and a driven-side main contact placed in a gas tank to face each other and configured to operate for opening and closing a circuit;

a driving-side arc contact and a driven-side arc contact placed to face each other and configured to operate for opening and closing the circuit;

a puffer shaft to which the driving-side arc contact is coupled;

a puffer cylinder fixed at a location outside the puffer shaft coaxially with the puffer shaft, the puffer cylinder having an end provided with the driving-side main contact;

an insulating nozzle fixed to the end of the puffer cylinder, the insulating nozzle providing a space in which an arc is generated when the circuit is opened by the driving-side arc contact and the driven-side arc contact;

a driver configured to drive the puffer shaft; and a puffer chamber in which arc-extinguishing gas being to be supplied to the space is stored, wherein the insulating nozzle is coupled to a driving rod, the driving rod is connected to a driven rod via a lever, the driven rod is electrically connected to the driven-side arc contact, and an elastic electrically conductive material is provided on an outer surface of the insulating nozzle, the outer surface of the insulating nozzle facing an inner surface of the driving-side main contact, the inner surface of the driving-side main contact facing radially inward toward the driving-side arc contact, wherein a surface of the elastic electrically conductive material is arranged in contact with the inner surface of the driving-side main contact, wherein the elastic electrically conductive material is a resin or a metal, a reinforcing member is provided on an outer surface of the elastic electrically conductive material, and the elastic electrically conductive material is fixed by being sandwiched by the insulating nozzle and the reinforcing member.

2. The gas-blast circuit breaker according to claim 1, wherein the elastic electrically conductive material is disposed in a gap between the inner surface of the driving-side main contact and the outer surface of the insulating nozzle.

3. The gas-blast circuit breaker according to claim 2, wherein the elastic electrically conductive material is a metallic elastic body, and the metallic elastic body is disposed in a groove having a circular shape and being provided on the inner surface of the driving-side main contact, the inner surface of the driving-side main contact facing the outer surface of the insulating nozzle.

4. The gas-blast circuit breaker according to claim 3, wherein direct-current voltage is applied across the driving-side main contact and the driven-side arc contact when the circuit is opened.

5. The gas-blast circuit breaker according to claim 2, wherein direct-current voltage is applied across the driving-side main contact and the driven-side arc contact when the circuit is opened.

6. The gas-blast circuit breaker according to claim 1, wherein direct-current voltage is applied across the driving-side main contact and the driven-side arc contact when the circuit is opened.

7. The gas-blast circuit breaker according to claim 1, wherein direct-current voltage is applied across the driving-side main contact and the driven-side arc contact when the circuit is opened.

* * * * *